US011297944B2

(12) United States Patent
Deckebach et al.

(10) Patent No.: US 11,297,944 B2
(45) Date of Patent: Apr. 12, 2022

(54) WINE RACK AND METHOD OF MAKING SAME

(71) Applicant: Wine Cellar Innovations, LLC, Cincinnati, OH (US)

(72) Inventors: James L. Deckebach, Cincinnati, OH (US); Anthony J. Wilke, Cincinnati, OH (US)

(73) Assignee: Wine Cellar Innovations, LLC, Cincinnati, OH (US)

( * ) Notice: Subject to any disclaimer, the term of this patent is extended or adjusted under 35 U.S.C. 154(b) by 0 days.

(21) Appl. No.: 16/797,502

(22) Filed: Feb. 21, 2020

(65) Prior Publication Data

US 2021/0059408 A1 Mar. 4, 2021

Related U.S. Application Data

(60) Provisional application No. 62/893,245, filed on Aug. 29, 2019.

(51) Int. Cl.
*A47B 73/00* (2006.01)
*A47F 7/28* (2006.01)

(52) U.S. Cl.
CPC ..... *A47B 73/00* (2013.01); *A47F 7/28* (2013.01)

(58) Field of Classification Search
CPC ..... A47B 73/00; A47B 73/006; A47B 73/008; A47B 96/061; A47F 7/28
USPC ..... 211/75
See application file for complete search history.

(56) References Cited

U.S. PATENT DOCUMENTS 887,272 A * 5/1908 Robinson ..... F16L 3/2235 248/68.1
1,129,553 A * 2/1915 Cope ..... F16L 3/13 248/73
1,206,203 A * 11/1916 Brockway ..... F16L 3/2235 248/68.1
2,081,216 A * 5/1937 Bosserman ..... A47F 7/175 211/44
2,285,632 A * 6/1942 Urbain ..... A47F 7/0035 211/60.1
D226,051 S * 1/1973 Fujinami ..... D6/552
3,746,179 A * 7/1973 Paumgardhen ..... A47B 73/00 211/75

(Continued)

FOREIGN PATENT DOCUMENTS

FR 2474449 A1 7/1981

*Primary Examiner* — Stanton L Krycinski
(74) *Attorney, Agent, or Firm* — Wood Herron & Evans LLP

(57) ABSTRACT

A wine rack includes a first support frame configured to be mounted to a support surface. The first support frame includes a base and at least one arm extending from the base, with the at least one arm being configured to support a first portion of a bottle. The wine rack further includes a second support frame configured to be mounted to the support surface in spaced relation to the first support frame. The second support frame includes a base and at least one arm extending from the base, with the at least one arm being configured to support a second portion of the bottle. The at least one arm of the first and second support frames includes one or more bottle contoured gravity stops. The at least one arm of the first and second support frames may also be inclined. A method of making a wine rack is also disclosed.

9 Claims, 12 Drawing Sheets

(56) References Cited

U.S. PATENT DOCUMENTS 3,923,277 A * 12/1975 Perrault ..... H02G 3/0456 248/49
4,450,989 A * 5/1984 Bogar, Jr. ..... A47B 81/005 211/64
4,482,065 A * 11/1984 Altemose ..... A47B 73/00 211/74
4,709,888 A * 12/1987 Cubit ..... F16L 3/221 248/68.1
D307,220 S * 4/1990 Kaufman, Jr. ..... D7/704
4,960,253 A * 10/1990 Perrault ..... F16L 3/22 248/68.1
D368,648 S * 4/1996 Losier ..... D8/356
5,505,316 A * 4/1996 Lee ..... B25H 3/04 206/376
D376,299 S 12/1996 Audet
5,632,457 A * 5/1997 Neely, Jr. ..... F16L 3/233 24/16 PB
D460,902 S * 7/2002 Battle ..... D7/708
6,443,316 B1 * 9/2002 Mao ..... A47F 5/0807 211/41.3
6,763,956 B2 * 7/2004 Woods ..... A47B 73/00 211/74
6,991,117 B2 1/2006 McCain
7,201,282 B1 * 4/2007 Alderman ..... A47B 81/00 211/100
7,234,254 B2 6/2007 Schmidt
7,284,671 B1 * 10/2007 Doscher ..... A63B 71/0036 211/59.1
7,850,017 B2 12/2010 McCain
7,882,967 B2 2/2011 Hynes
8,231,015 B2 7/2012 McCain
8,596,590 B2 * 12/2013 McCoy ..... F16L 3/223 248/68.1
8,684,194 B2 4/2014 McCain
8,777,019 B2 * 7/2014 Dovell ..... A47B 73/00 211/74
8,840,071 B2 * 9/2014 Oh ..... F16L 3/221 248/68.1
8,973,766 B2 * 3/2015 Sprang, Jr. ..... B25H 3/04 211/70.6
9,149,115 B2 * 10/2015 Kasza ..... A47F 5/0823
D751,871 S 3/2016 Polley et al.
9,364,085 B2 6/2016 McCain
9,763,515 B2 * 9/2017 Fratilla ..... A47B 96/1441
9,781,999 B2 10/2017 McCain
10,004,330 B1 6/2018 Kasza
2011/0132853 A1 6/2011 Drobot et al.
2012/0085721 A1 * 4/2012 Michael J. ..... A47F 5/0853 211/103
2014/0339182 A1 11/2014 Koder et al.
2016/0007743 A1 1/2016 Koder et al.
2017/0360195 A1 12/2017 McCain
2019/0021492 A1 * 1/2019 Sill ..... A47B 73/00
2019/0365095 A1 * 12/2019 Di Prima ..... A47B 73/00

* cited by examiner

WINE RACK AND METHOD OF MAKING SAME

TECHNICAL FIELD

This invention generally relates to a wine rack, and more particularly to an improved support frame for a wine rack. The invention is also directed to a method of making a support frame for a wine rack.

BACKGROUND

Wine racks are used in many private and commercial settings for storing and displaying bottles of wine. Many conventional wine racks include a grid of generally circular of rectangular cavities arranged next to each other and configured to receive a wine bottle within the cavity such that the cork end of the bottle extends from the cavity and is visible to a user. More recently, more open racks have been developed that allow a greater portion of the bottle to be visible to a user. For example, such racks may allow the label portion of the bottle to be visible when the bottle is supported in the rack, thereby providing a user with better selectability of the wines in the wine rack.

While such racks are generally successful for their intended purpose, modern racks still suffer from several deficiencies. For example, while many open-style racks allow greater visibility of the bottle, this enhanced visibility may come at a cost of diminished control of the bottle in the rack. More particularly, in many modern wine racks a bottle may engage with the rack at just a few contact points and over a relatively small area on the bottle. Accordingly, modern wine racks may be more susceptible to bottle breakage due to unforeseen bumps, knocks and vibrations. By way of example, many areas of the world are susceptible to various unpredictable tremors and earthquakes. Due to the costs of the wine being stored or displayed in the wine rack, it is desirable that wine racks be able to maintain control over the wine bottles in the rack during tremors and other earthquake events. Open wine rack designs are generally not designed or equipped to maintain a high level of control of the bottles in the rack during such events.

In addition to the above, many modern wine racks are assembled from many parts, making the manufacture and assembly of the racks more costly and complex. Furthermore, more modern wine rack designs are not particularly robust and may lack the structural integrity required to give a user the confidence that the rack can adequately hold a full array of wine bottles.

Therefore, there is a need for an improved wine rack capable of maintaining control over an array of wine bottles during tremors, earthquakes, and other vibration-inducing events. There is also a need for a wine rack that has improved structural integrity and a method for making such a wine rack.

SUMMARY OF THE INVENTION

A wine rack includes a first support frame configured to be mounted to a support surface. The first support frame includes a base and at least one arm extending from the base, with the at least one arm being configured to support a first portion of a bottle. The wine rack further includes a second support frame configured to be mounted to the support surface in spaced relation to the first support frame. The second support frame includes a base and at least one arm extending from the base, with the at least one arm being configured to support a second portion of the bottle. The at least one arm of the first and second support frames further includes one or more bottle contoured gravity stops.

In an exemplary embodiment, the at least one arm of the first support frame of the wine rack is integrally formed with the base so as to define a one-piece construction. Similarly, the at least one arm of the second support frame of the wine rack is integrally formed with the base so as to define a one-piece construction. Further, the one or more bottle contoured gravity stops may be integrally formed with the at least one arm of the first and second support frames. Each of the one or more bottle contoured gravity stops may include an arcuate forward face. Additionally, each of the one or more bottle contoured gravity stops may also include a planar rear face. More specifically, the planar rear face is may be perpendicular to the at least one arm from which it extends. In another embodiment, the at least one arm of the first and second support frames may be inclined at an acute angle relative to horizontal. Additionally, corresponding arms on the first and second support frames may be offset in a vertical direction. In one embodiment, the corresponding bottle contoured gravity stops on the first and second support frames may also be offset in a lateral direction.

In another embodiment, the wine rack may further include a locking mechanism with one or more safety straps for securing the wine bottles to the wine rack. More specifically, the first and second support frames may include one or more attachment points for engaging with the one or more safety straps. In an alternative embodiment, at least one of the one or more attachment points may be positioned on the bottle contoured gravity stops. In one embodiment, the first support frame of the wine rack may include a first support leg and side panel and the second support frame of the wine rack includes a second support leg and side panel. Further, the first support frame and second support frame may be coupled to a support structure for supporting the wine rack in a stand-alone configuration.

In yet another embodiment, a wine rack includes a first support frame configured to be mounted to a support surface and a second support frame configured to be mounted to the support surface in spaced relation to the first support frame. Each of the first and second support frames include a base and at least one arm extending from the base. The at least one arm includes a bearing surface and nonbearing surface. In this manner, the at least one arm of the first support frame is aligned with the at least one arm of the second support frame when mounted to the support surface with the bearing surface of each arm being configured to engage and supports a bottle in a cradled position such that a portion of the bottle is positioned between the at least one arm of the first support frame and at least one arm of the second support frame. The bearing surface of the at least one arm of the first and second support frames may be rounded, having a predetermined radius of curvature. Furthermore, the at least one arm of the first and second support frames may be inclined at an acute angle relative to horizontal. The wine rack may further include a cross support assembly including a stabilizing assembly and one or more attachment points positioned on the at least one arm of the first and second support frames. More specifically, the one or more attachment points may include a boss positioned on the nonbearing surface of the at least one arm of the first and second support frames. The boss may further include a centrally located aperture configured to receive a portion of the stabilizing assembly therethrough. A method of making a wine rack is also disclosed and includes providing a generally planar sheet of material and cutting the planar sheet of material along a predetermined pattern that defines a support frame of the wine rack so that the resulting support frame has a one-piece, monolithic construction. In one embodiment, cutting the sheet of material may include laser cutting the sheet of material to form the support frame. The method may further include bending a portion of the sheet material to form a flange of the support frame. Additionally, the method may also include polishing the cut surfaces of the support frame of the wine rack.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
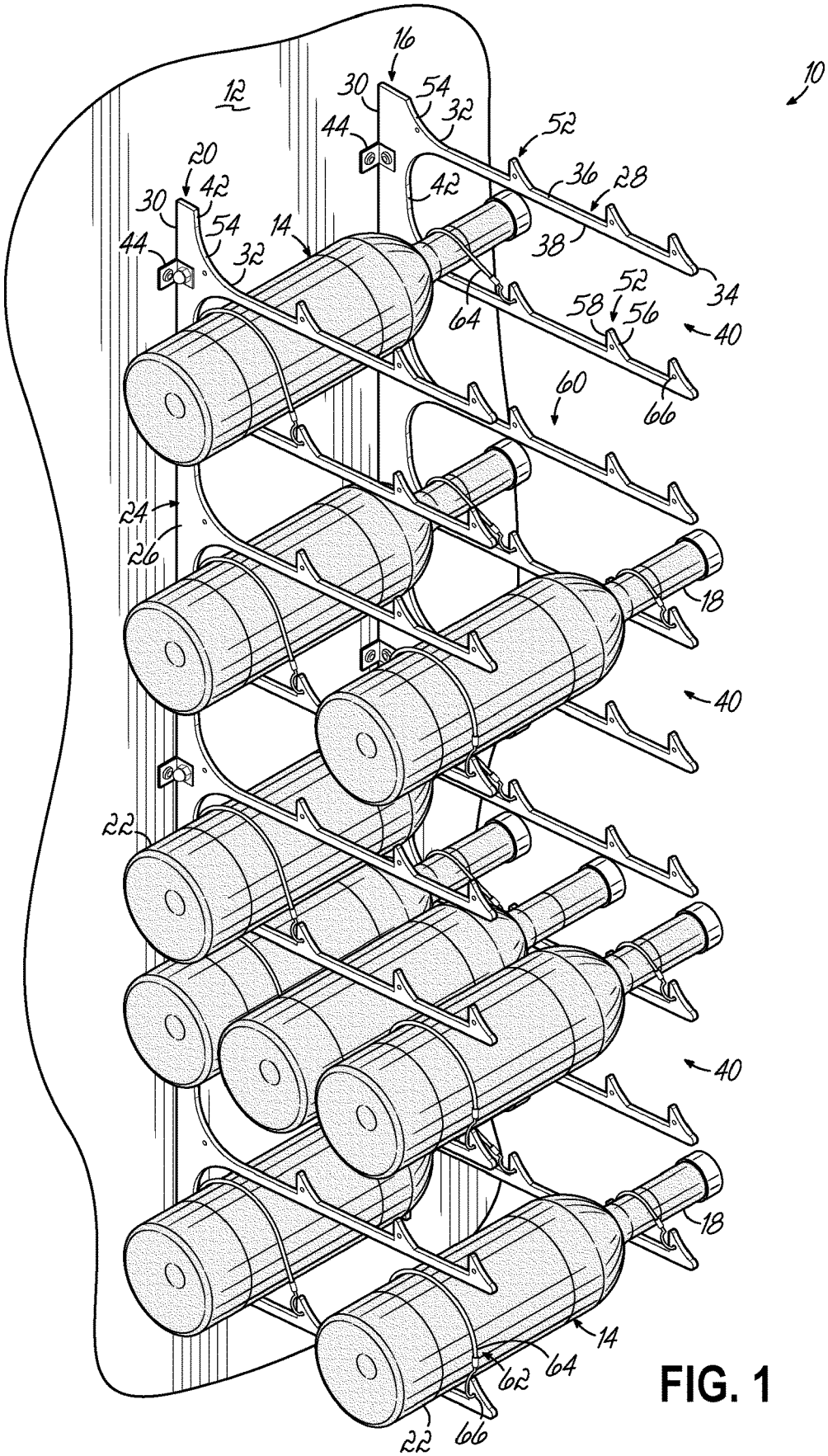
FIG. 1 is a schematic perspective view a wine rack in accordance with an embodiment of the invention supporting a plurality of wine bottles.

FIG. 1 illustrates a wine rack 10 in accordance with an exemplary embodiment of the invention mounted to a wall or support surface 12 and configured to support one or more wine bottles 14 therein. The wine rack 10 includes a first support frame 16 configured to support a first portion of the one or more wine bottles 14, such as a neck 18 of the bottles 14, and a second support frame 20 configured to support a second portion of the one or more wine bottles 14, such as a shank 22 of the bottles 14. The first and second support frames 16, 20 are configured to support one or more bottles 14 in an improved manner. More particularly, the first and second support frames 16, 20 are configured to support the one or more bottles 14 in a manner that can survive various tremors, earthquakes, and other natural and unnatural vibratory disturbances without having the bottles 14 separate from the rack 10 and potentially break.

Figure 2:
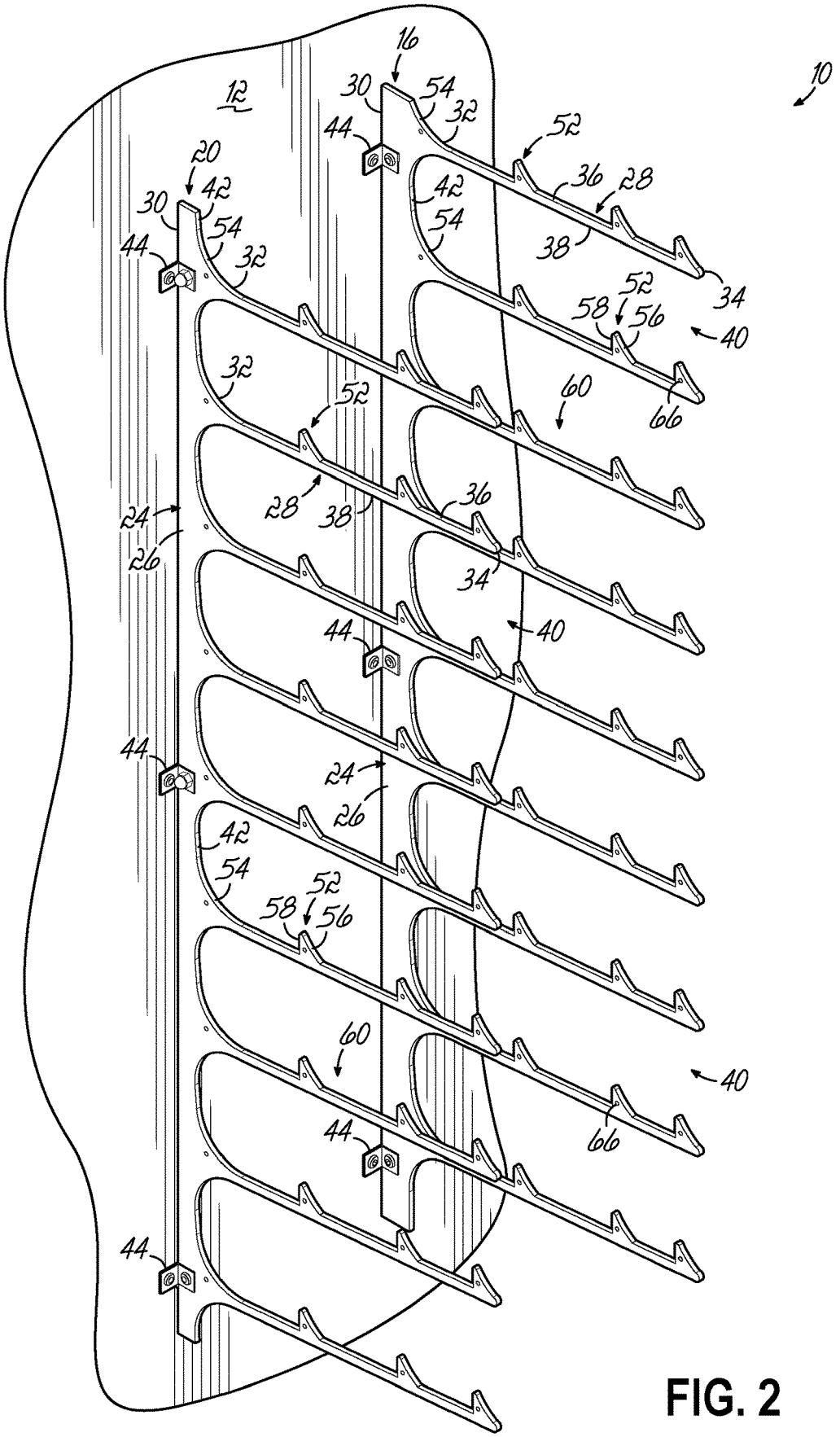
FIG. 2 is a schematic perspective view of the wine rack illustrated in FIG. 1 but without the wine bottles.

With reference to FIGS. 1 and 2, each of the first and second support frames 16, 20 have a similar construction and generally include a plate-like body 24 having a base 26 and one or more elongate support arms 28 extending away from the base 26 and outwardly from the support surface 12. The base 26 is configured to mount to the support surface 12 and defines a rear edge 30 configured to be in engagement with or in near engagement with the support surface 12 when the wine rack 10 is mounted thereto, as explained in further detail below. In an exemplary embodiment, the first and second support frames 16, 20 may be formed from a metal, such as steel. However, forming the support frames 16, 20 from other metals or materials may be possible as well and remain within the scope of the present invention.

With continued reference to FIGS. 1 and 2, the body 24 of the first and second support frames 16, 20 may include at least one and preferably a plurality of vertically arranged support arms 28 extending away from the support surface 12. By way of example and without limitation, each support frame 16, 20 may include anywhere between 1 and 30 support arms 28, depending on, for example, the desired size of the wine rack 10. The height of the wine rack 10 may be limited by, for example, the physical space in which the wine rack 10 is being positioned. To this end, the wine rack 10 may extend from a floor to a ceiling of a room, or may be shorter depending on the needs and preferences of the user. In any event, each of the arms 28 includes a proximal end 32 coupled to the base 26 of the support frame 16, 20, a distal end or tip 34, an upper bearing surface 36, and a lower non-bearing surface 38. The region between adjacent, vertically-spaced arms 28 on each of the support frames 16, 20 defines a U-shaped cavity 40 having a base 42 which defines a generally arcuate wall.

The length of the arms 28 extending from the base 26 on each of the support frames 16, 20 may depend on the number of bottles 14 the arms 28 are configured to support. Each of the arms 28 is configured to support at least one bottle 14 but may support up to four or five bottles. By way of example and without limitation, each of the arms 28 illustrated in FIGS. 1-3 and 5-8 is configured to hold up to three bottles 14. This number, however, may vary and remain within the scope of the present invention. In one embodiment, the number of bottles 14 each of the arms 28 on the support frames 16, 20 is configured to support may be the same. For example, as illustrated in FIGS. 1-3 and 5-8, each arm 28 on the first support frame 16 (and each corresponding arm on the second support frame 20) is configured to support up to three bottles 14. In an alternative embodiment, however, the number of bottles 14 each arm 28 is configured to support may vary in the vertical direction of the wine rack 10 (not shown). For example, near the bottom portion of the wine rack 10, the corresponding arms 28 of the first and second support frames 16, 20 may support a first number of bottles 14, such as one or two bottles 14, and near an upper portion of the wine rack 10, the corresponding arms 28 of the first and second support frames 16, 20 may support a second number of bottles 14, such as three of four bottles 14. Thus, the wine rack 10, and more particularly the first and second support frames 16, 20, may have a wide variety of arrangements for supporting a plurality of wine bottles 14.

Figure 3:
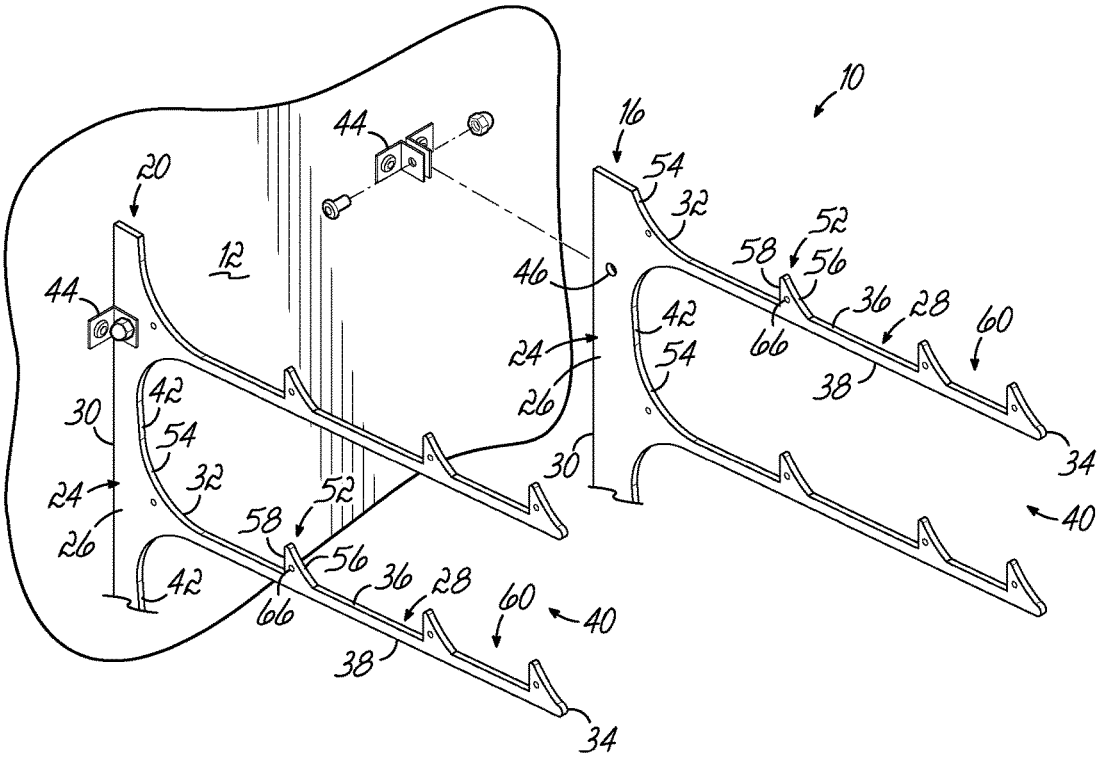
FIG. 3 is a partial, disassembled, perspective view of the wine rack shown in FIG. 2.
Figure 4:
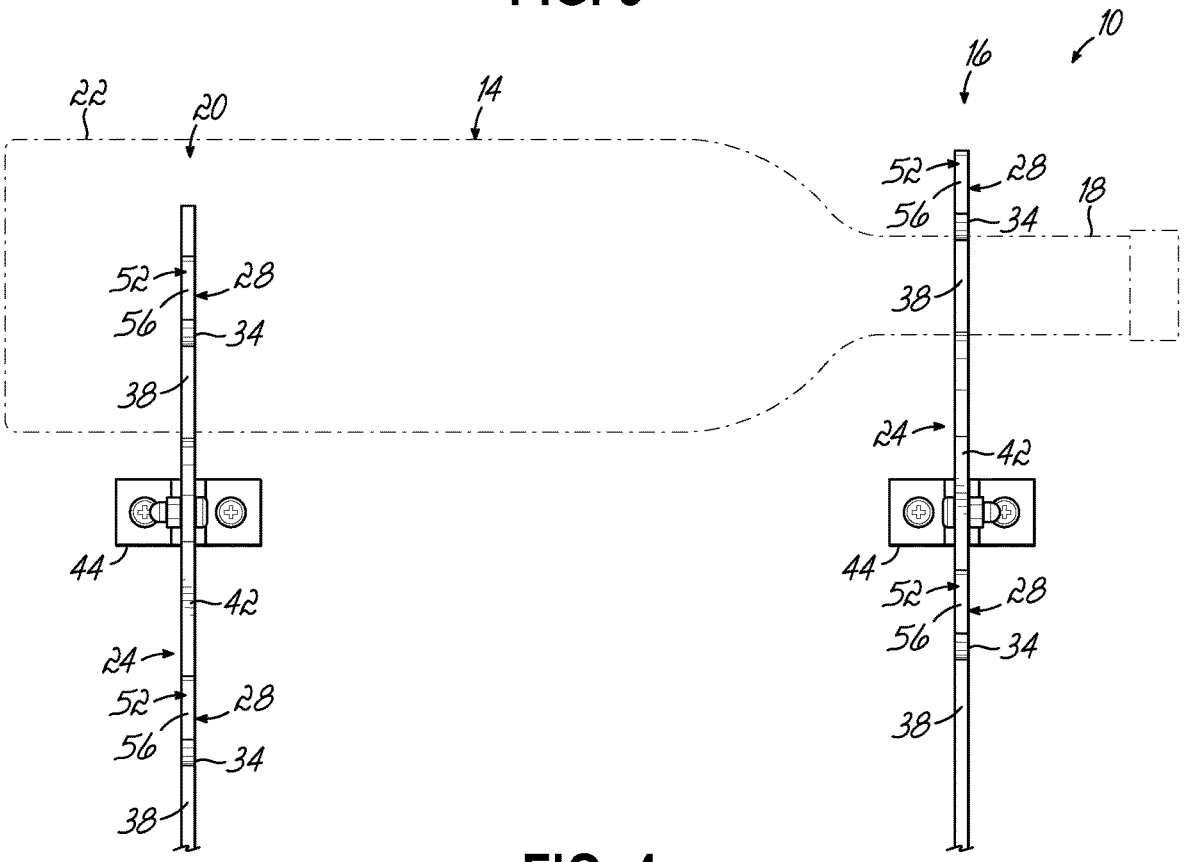
FIG. 4 is a front elevation view of the wine rack shown in FIG. 3.

Turning now to FIGS. 3 and 4, with continued reference to FIGS. 1 and 2, a mounting system may include a plurality of brackets 44 (e.g., L-shaped brackets) to mount each of the first and second support frames 16, 20 to the support surface 12. As shown, the body 24 of each of the first and second support frames 16, 20 may include a plurality of apertures 46, proximate to the base 26 and spaced along the length of the body 24 for securing one or more brackets 44 thereto. However, it should be recognized that the support frames 16, 20 may be mounted to the support surface 12 in many different ways and aspects of the invention are not limited to the particular arrangement shown in FIGS. 1-4. Alternatively, for example, the support surface may be the floor and ceiling of a room instead of the wall.

Figure 5:
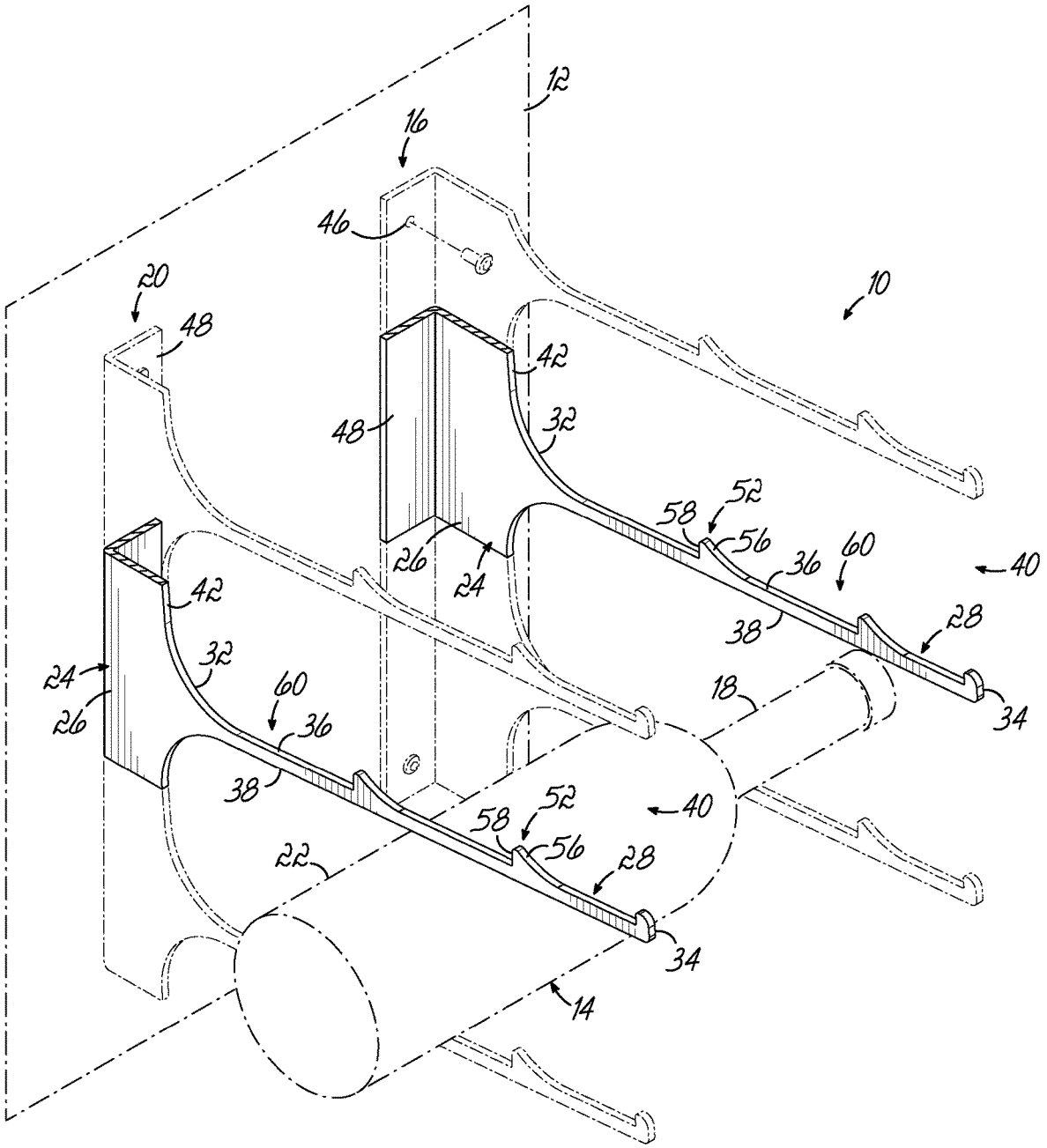
FIG. 5 is a partial, side elevation view of a support frame of a wine rack in accordance with another embodiment of the invention.

With reference to FIG. 5, an alternative embodiment of the wine rack 10 is shown having a different configuration for mounting the first and second support frames 16, 20 to the support surface 12. As shown, the base 26 of each of the first and second support frames 16, 20 includes a generally rectangular flange 48 extending away from the base 26 and body 24 of the support frames 16, 20. The flange 48 is configured to mount flush to the support surface 12 such that the one or more elongate arms 28 extend away from the flange 48 of base 26 and outwardly from the support surface 12. As shown, the rectangular flange 48 may be integrally formed with the base 26 such that the base 26 of each of the first and second support frames 16, 20 is substantially L-shaped. For example, the first and second support frames 16, 20 may be formed with a larger body 24 so that a portion of the body 24 may be bent ninety degrees to form the flange 48 and L-shaped configuration of each support frame 16, 20. Each flange 48 may have a plurality of apertures 46 spaced along the length of the flange 48 for receiving mounting hardware therethrough, such as screws, bolts, or the like, for securing the first and second support frames 16, 20 to the support surface 12. Different configurations for the flange 48 may be possible, such as varying the cross-sectional shape and size, for example, without departing from the scope of the present invention.

In an exemplary embodiment, each of the arms 28 includes one or more bottle contoured gravity stops 52 for engaging and supporting one or more bottles 14 positioned at spaced-apart locations along the arms 28. Similar to the above-discussed embodiments, the number of bottle contoured gravity stops 52 depends on the number of bottles 14 being supported by the arms 28. At the proximal end 32 of the arms 28, the base 42 of each U-shaped cavity 40 operates as a bottle contoured gravity stop 52 for an inner most bottle 14 being carried by the arms 28. Moreover, in an exemplary embodiment the tip end 34 of the arms 28 may also include a bottle contoured gravity stop 52. This bottle contoured gravity stop 52 effectively operates as a stop element such that an outer most bottle 14 positioned on the arms 28 cannot easily and unintentionally become separated from the arms 28 (e.g., an outermost bottle cannot simply roll off the arms 28). The number of intermediate bottle contoured gravity stops 52 positioned between the proximal and distal ends 32, 34 of the arms 28 depends on the number of bottles 14 the arms 28 are configured to support. Generally, the number of intermediate bottle contoured gravity stops 52 is one less than the number of bottles 14 the arms 28 are configured to support. Thus, in the embodiment shown in the figures for which the arms 28 are configured to support three bottles 14, there are two bottle contoured gravity stops 52 positioned between the proximal and distal ends 32, 34.

Figure 6:
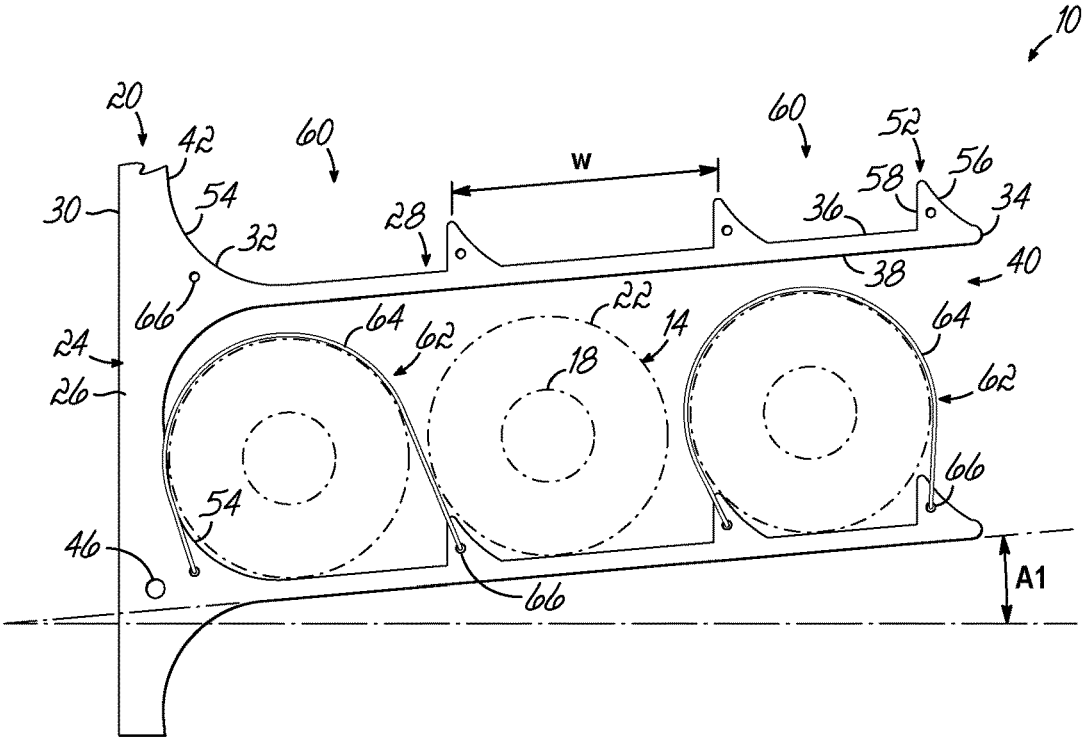
FIG. 6 is a partial, side elevation view of a support frame of the wine rack shown in FIG. 3.
Figure 7:
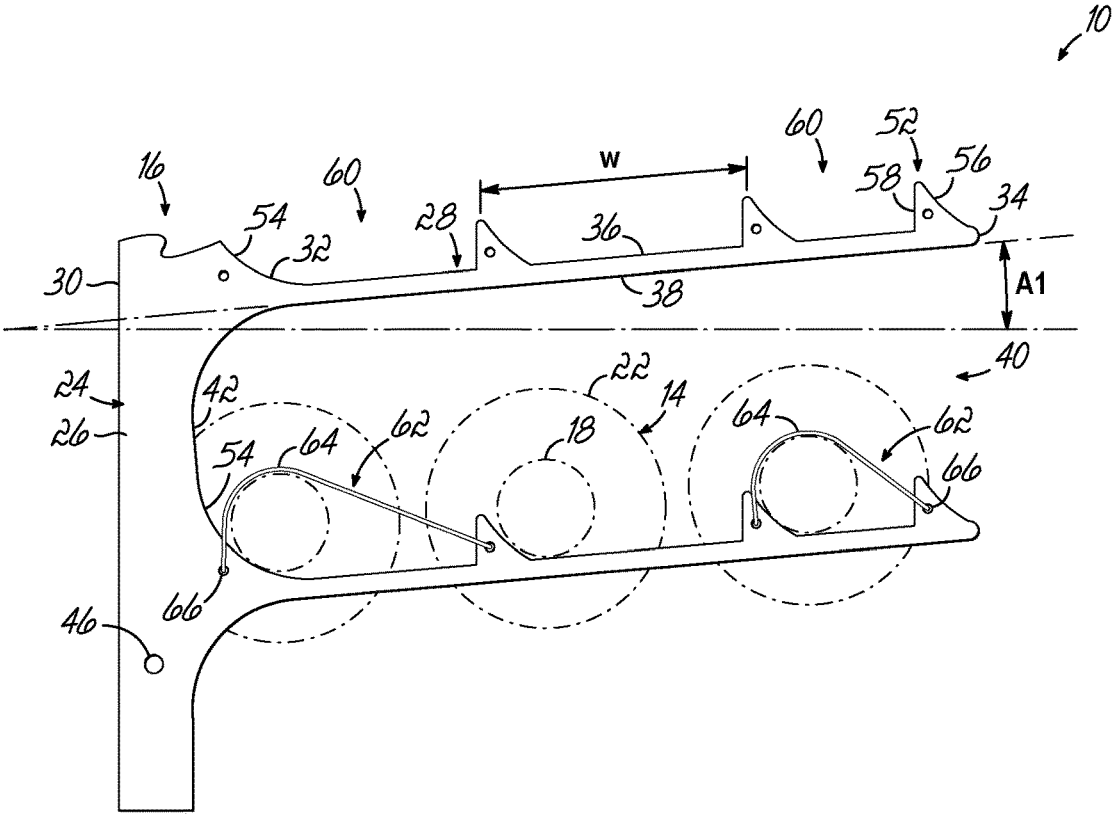
FIG. 7 is a partial, side elevation view of the support frame of the wine rack shown in FIG. 3.
Figure 8:
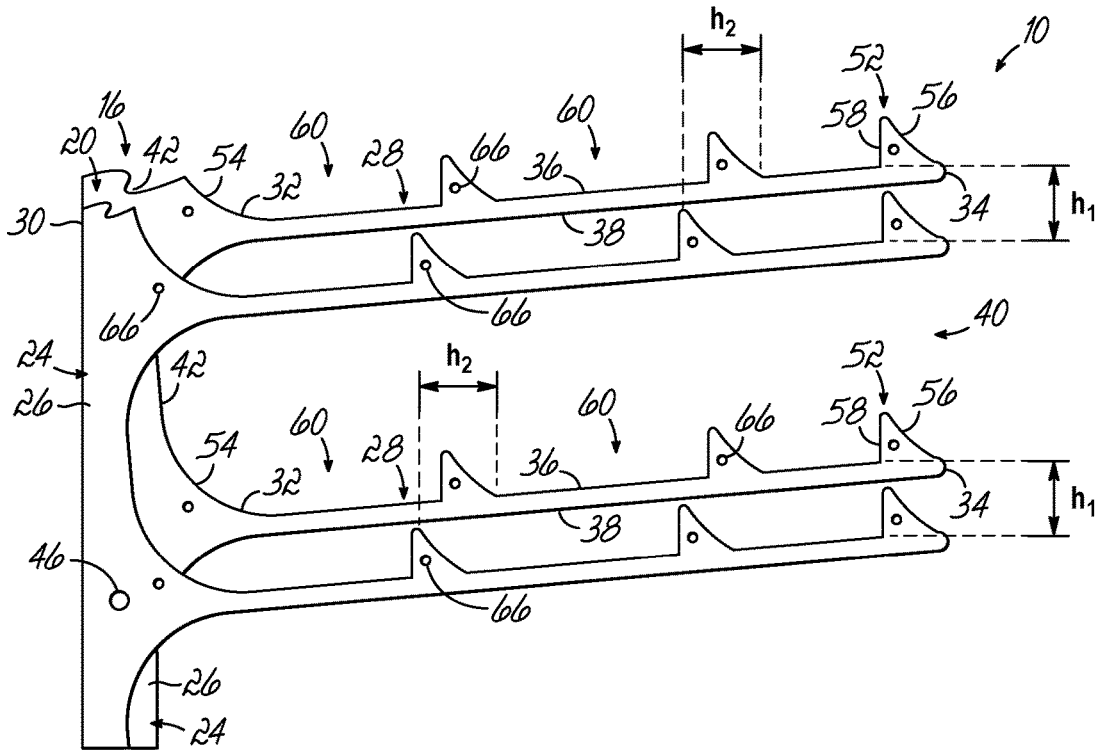
FIG. 8 is a partial, side elevation view of both support frames of the wine rack shown in FIG. 3.

As perhaps best illustrated in FIGS. 6-8, the bottle contoured gravity stop 52 at the proximal end 32 of the arms 28 includes an arcuate forward face 54 configured to confront and possibly engage with an outer surface of a bottle 14. In this regard, the arcuate forward face 54 may form a portion of the base 42 of the U-shaped cavity 40. The forward face 54 may have a radius of curvature that relates to or corresponds to the curved outer surface of a bottle 14. By way of example, the forward face 54 may have a radius of curvature of about one and one-half inches. It should be recognized, however, that other values may be possible and remain within the scope of the present invention.

The bottle contoured gravity stop 52 located at the tip end 34 and the intermediate bottle contoured gravity stops 52 each extend upwardly away from the upper surface 36 of the arms 28. For example, the bottle contoured gravity stops 52 may extend above the upper surface 36 of the arms 28 at a height of between about one-half inches and about three-fourths inches. Other values, however, may be possible. In an exemplary embodiment, the tip and intermediate bottle contoured gravity stops 52 may have a generally triangular configuration including a generally arcuate forward face 56 and a generally planar rear face 58. The forward face 56 is configured to confront and possibly engage with an outer surface of a bottle 14 and may have a radius of curvature that relates to or corresponds to the curved outer surface of the bottle 14 (i.e., for the intermediate gravity stops). By way of example, the forward face 56 may have a radius of curvature of about one and three-fourths inches. Other values, however, may be possible. The rear face 58 is generally not meant to engage with a bottle 14 in the normal course of the wine rack 10. Instead, the rear face 58 is configured to operate as a stop to resist movement of a bottle 14 along the arms 28 and toward the tip end 34. Thus, for example, in one embodiment the rear face 58 may form a generally perpendicular angle to the upper surface 36 of the arms 28. Other angles of the rear face 58, however, may also be possible. Additionally, it should be recognized that the bottle contoured gravity stops 52 are not limited to a triangular shape but may have other shapes. To this end, the bottle contoured gravity stops 52 located on the tip end 34 of the arms 28 may be identical to the other bottle contoured gravity stops 52 positioned along the arms 28 as shown in FIGS. 1-3. Alternatively, some or all of the bottle contoured gravity stops 52 may have a different configuration compared to the other contoured gravity stops 52, as shown in FIG. 5. For example, the height of the rear face 58 of the bottle contoured gravity stop 52 located on the tip end 34 may be greater than or less than the height of the rear faces 58 of the remaining contoured gravity stops 52. Similarly, the radius of curvature for the forward face 56 of the contoured gravity stop 52 located on the tip end 34 may be varied compared to that of the remaining intermediate contoured gravity stops 52 on the arm 28.

In an exemplary embodiment, the bottle contoured gravity stops 52 may be integrally formed on the arms 28. In an alternative embodiment, however, the bottle contoured gravity stops 52 may be separate elements that are coupled to the arms 28 during assembly of the wine rack 10. Furthermore, the arrangement of the bottle contoured gravity stops 52 on the arms 28 define one or more stations 60 having a width w for receiving a wine bottle 14. In one embodiment, the distribution of the bottle contoured gravity stops 52 is such that each station 60 has a generally constant width. Aspects of the invention, however, are not so limited and in an alternative embodiment the width of the stations 60 may vary along the length of the arms 28. By way of example, the width of the outermost station 60 adjacent the tip end 34 may have the smallest width. Of course, other width arrangements of the stations 60 along the arms 28 are also possible and remain within the scope of the present invention.

Figure 7A:
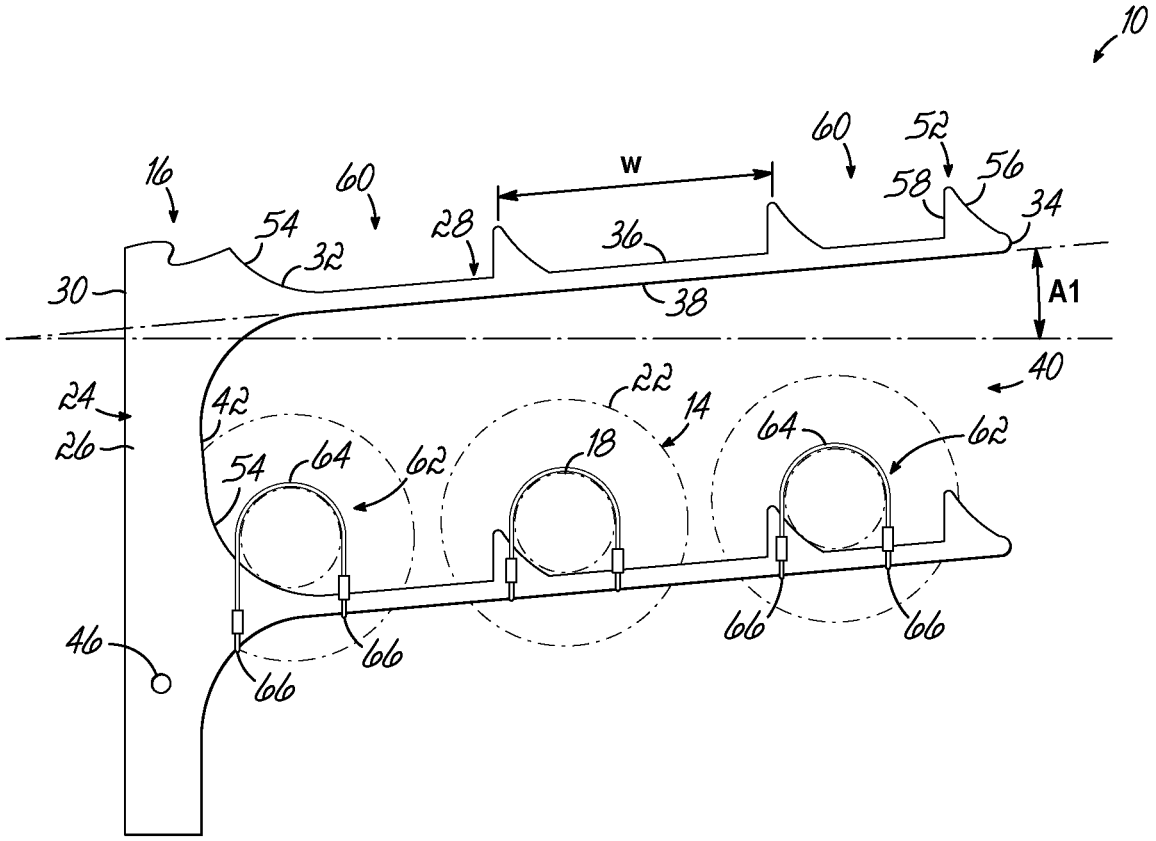
FIG. 7A is a partial, side elevation view of a support frame in accordance with an alternative embodiment of the invention.

In accordance with an aspect of the invention and as best illustrated in FIGS. 6-7A, the arms 28 of the first and second support frames 16, 20 are configured to extend away from the support surface 12 at an angle A1. As shown, angle A1 creates a slightly greater than ninety degrees angle between the lower surface 38 of each support arm 28 and the support surface 12. By way of example, the arms 28 may be configured to extend away from the support surface 12 at an angle between 2 degrees and 10 degrees greater than ninety degrees (perpendicular). In an exemplary embodiment, for example, the arms 28 may extend away from the support surface 12 at an angle 5 degrees greater than perpendicular (i.e., A1 is equal to 5 degrees). The incline of the arms 28 above perpendicular provides a first mechanism for controlling bottles 14 supported in the wine rack 10.

In this regard, it is known that large portions of the world are subject to various tremors and earthquakes. Low level tremors or earthquakes will cause the wine bottles in a wine rack to shake or vibrate during such seismic events. In some instances, the vibrations may be significant and cause the wine bottles 14 to shift or move in the wine rack 10. In conventional wine racks, some bottles may become separated from the wine rack and break. In accordance with one aspect of the invention, inclining the arms 28 upwardly relative to perpendicular reduces the likelihood of the bottles 14 in wine rack 10 from becoming separated during a relatively small seismic event. In this regard, as the bottles 14 shake during the event, gravity urges the bottles 14 toward the proximal end 32 of the arms 28 or the base 42 of the U-shaped cavities 40 due to the inclined position of the arms 28. Thus, the bottles 14 cannot escape from the wine rack 10 by moving in this direction. The bottles 14 may escape from the wine rack 10 by moving toward the tip end 34 of the arms 28. But gravity does not urge the bottles 14 in that direction during a relatively low-level seismic event. Thus, while there may be some shifting of bottles 14 in the wine rack 10, the chances of any bottles 14 becoming separated from the rack 10 is reduced.

In accordance with another aspect of the invention, the wine rack 10 may include a second mechanism for controlling bottles 14 supported in the wine rack 10 in the event of a seismic event that is generally stronger than low-level tremors and earthquakes. This second mechanism operates as a locking feature preventing the bottles 14 from becoming separated from the arms 28 which support the bottles 14. In an exemplary embodiment, as illustrated in FIGS. 6 and 7, one or more corresponding stations 60 of the first and second support frames 16, 20 may be provided with a locking mechanism 62 that includes at least one safety strap 64 and one or more attachment points 66 to which the safety straps 64 are configured to attach. Thus, for each stored wine bottle 14, there is a safety strap for the shank 22 and another safety strap for the neck 18. The safety straps 64 may take various forms including cords, strings, cables, straps, bands, etc. While in one embodiment, the safety straps 64 may be inelastic, in a preferred embodiment, the safety straps 64 are elastic. For example, in one embodiment the safety straps 64 may be bungee cords. The elasticity of the safety straps 64 biases the bottles 14 towards the upper surface 36 and into engagement with the arms 28.

With continued reference to FIGS. 6 and 7, the attachment points 66 of the first and second support frames 16, 20 are configured to engage with the ends of the safety straps 64. In one embodiment, the attachment points 66 are formed by a plurality of holes or openings in the first and second support frames 16, 20. Other attachment points 66 are possible and include various hooks, bosses, clips, snaps, etc. In one embodiment, the attachment points 66 are positioned in the bottle contoured gravity stops 52. However, it should be recognized that the attachment points 66 may be positioned in other locations on the arms 28 or the support frames 16, 20. By way of example, FIG. 7A illustrates an alternative embodiment where the safety straps 64 are engaged with the arms 28 (e.g., hook to arms 28 or wrap around the arms 28) immediately adjacent to the bottle 14 being secured by the straps 64. In this embodiment, the holes in the bottle contoured gravity stops 52 may be omitted. As illustrated in the figures, the ends of the safety straps 64 are configured to couple to the support frames 16, 20 and engage with the outer surface of the bottles 14 to secure the bottles to respective arms 28. In this regard, the strap 64 that engages with the shank 22 of the bottle may be larger compared to the strap 64 that engages the neck 18 of the bottle. Thus, during a relatively strong earthquake, the bottles 14 will remain coupled to the wine rack 10 and avoid bottle breakage and the costs associated therewith.

In accordance with another aspect of the invention, the bottles 14 in the wine rack 10 are configured to be substantially horizontal relative to ground (e.g., the floor of a home or cellar) and relatively parallel to the support wall 12 to which the wine rack 10 is coupled. Due to the irregular shape of a typical wine bottle, the wine rack 10, and more particularly the support frames 16, 20, define certain offsets to ensure that the orientation of the bottles 14 relative to both the ground and the support wall 12 are as desired. These offsets are best illustrated in FIG. 8. As shown, the first support frame 16 supporting the neck 18 may be offset vertically upwards relative to the second support frame 20 which supports the shank 22 such that the corresponding arms 28 of the support frames 16, 20 are offset by an amount $h_1$. The offset $h_1$ generally corresponds to the change in height of the bottle 14 and, more specifically, the change in height between the neck 18 and the shank 22. Thus, for a standard wine bottle 14, this offset will be a known amount and the positioning of corresponding arms 28 on the support frames 16, 20 may be arranged accordingly. In this way, when a bottle 14 is positioned on corresponding arms 28 of the wine rack 10, the shank 22 of the bottle 14 engages an arm 28 of the second support frame 20 and the neck 18 of the bottle 14 engages an arm 28 of the first support frame 16 such that the bottle 14 is substantially horizontal relative to the ground.

To maintain the bottles 14 in a position substantially parallel to the support wall 12, the wine rack 10 needs to have an offset in the longitudinal direction along the arms 28. This alignment is dictated by the positioning of the bottle contoured gravity stops 52 along the length of the arms 28 of the support frames 16, 20. As illustrated in FIG. 8, the bottle contoured gravity stops 52 on the first support frame 16 for supporting the neck 18 are offset laterally toward the tip end 34 (to the right from the perspective shown in FIG. 8) relative to the bottle contoured gravity stops 52 on the second support frame 20 for the shank 22 by an amount $h_2$. The offset $h_2$ generally corresponds to the change in width of the bottle 14 between the neck 18 and the shank 22. Thus, for a standard wine bottle 14, this offset will be a known amount and the positioning of bottle contoured gravity stops 52 on the support frames 16, 20 may be arranged accordingly. In this way, when a bottle 14 is positioned on corresponding arms 28 of the wine rack 10, the shank 22 of the bottle 14 engages a bottle contoured gravity stop 52 on the second support frame 20 and the neck 18 of the bottle 14 engages a corresponding bottle contoured gravity stop 52 on the first support frame 16 such that the bottle 14 is substantially parallel to the support surface 12. The arrangement of the bottles 14 in the wine rack 10 as described above provide a very aesthetically pleasing appearance to the wine rack 10.

As discussed above, in an exemplary embodiment of the invention, the arms 28 may be integrally formed with the base 26 of the body 24 for each of the support frames 16, 20. Moreover, the bottle contoured gravity stops 52 may be integrally formed with the arms 28. In other words, the support frames 16, 20 have a one-piece, monolithic construction that provides strength and integrity to the wine rack 10. In this regard, the integral nature of the arms 28 and the body 24 is believed to increase the strength and load-carrying ability of the arms 28 and wine rack 10 overall. For example, the arms 28 may accommodate a greater number of bottles 14 (e.g., 7-10 bottles) without concern for structural integrity. Alternatively, the improved design may allow for a thinner piece of material (e.g., metal) for forming the support frames 16, 20, which in turn may reduce costs. In any event, the integral nature of the arms 28 and the bottle contoured gravity stops 52 provides a stronger wine rack 10, which opens up greater design possibilities.

Figure 9:
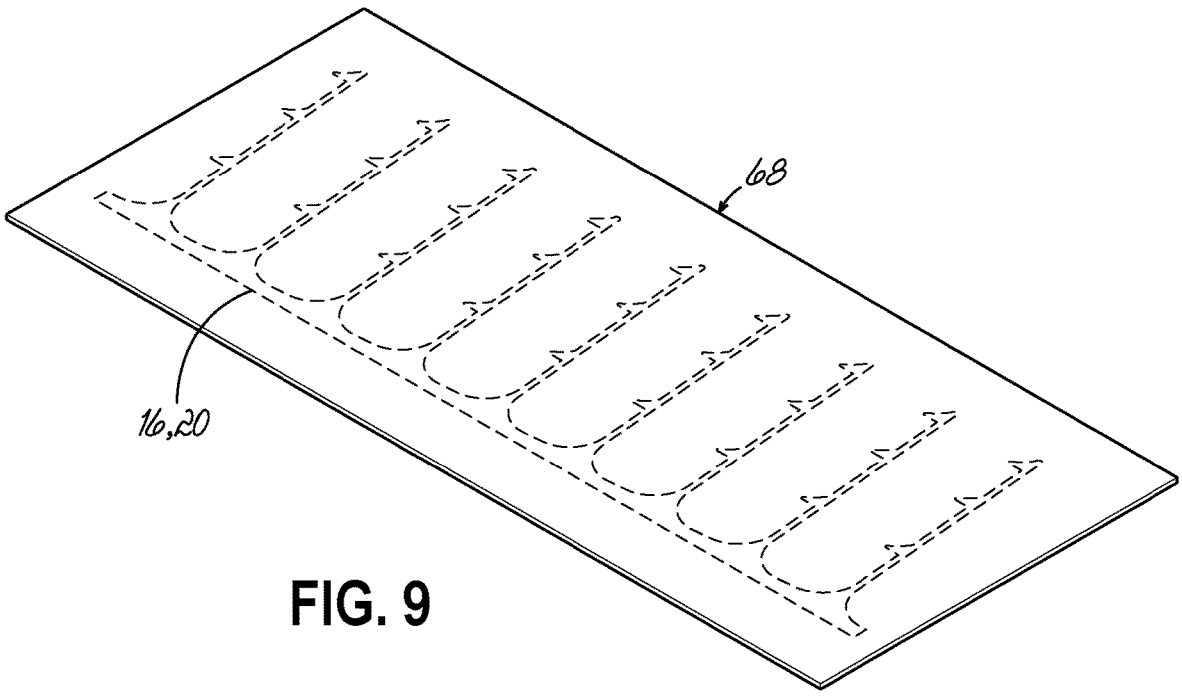
FIG. 9 is a schematic illustration of how to form a support frame of the wine rack in accordance with an embodiment of the invention.
Figure 10:
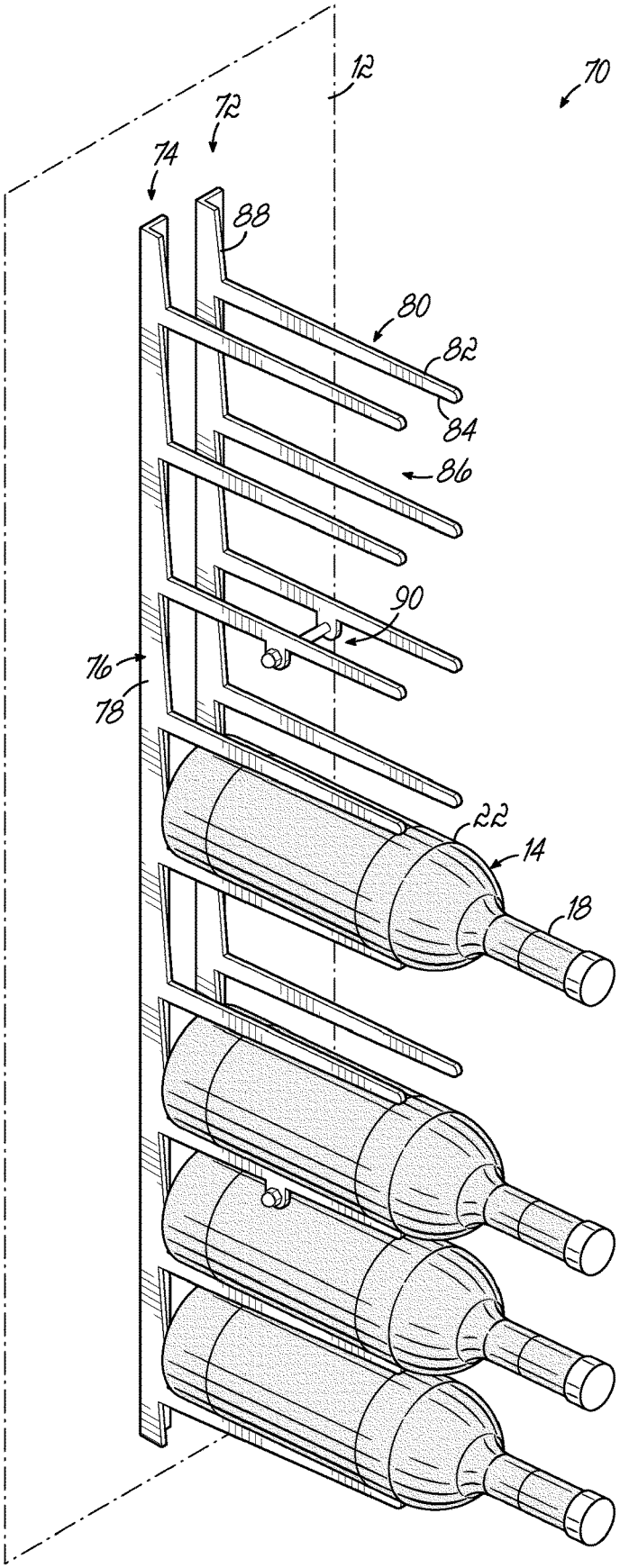
FIG. 10 is a schematic perspective view a wine rack in accordance with another embodiment of the invention supporting a plurality of wine bottles.

In one exemplary embodiment and as illustrated in FIG. 9, the support frames 16, 20 may be formed from a generally planar workpiece 68. The workpiece 68 may be formed from metal, such as steel sheeting, or other suitably strong material. The workpiece 68 may have a desired thickness for the support frames 16, 20. For example, the workpiece 68 may be between about one-sixteenth inches thick to about three-eighths inches thick. The one-piece support frames 16, 20 may then be cut from the workpiece 68. Various cutting techniques may be used to form the support frames 16, 20 from the workpiece. By way of example and without limitation, a laser cutting technique may be used to form the support frames 16, 20. Commercially available laser-based metal sheet cutters are generally known and thus a detailed discussion of such devices will not be provided herein. After cutting the support frames 16, 20 from the workpiece 68, various post-processing techniques may be implemented to smooth cut surfaces (e.g., remove burrs or other defects or imperfections) and polish the surfaces of the wine rack 10 for presentation to a user. It should be understood that the support frames 16, 20 in the embodiment shown in FIG. 5 may also integrally be formed from workpiece 68. In this regard the flange 48 may be provided for in workpiece 68 and subsequently bent to provide the flange 48 in an L-shape.

FIGS. 10-13 illustrate another embodiment in accordance with aspects of the invention. These figures illustrate a wall or surface 12 mounted wine rack 70 configured to hold one or more wine bottles 14, positioned one above the other, such that the wine bottles 14 are supported by the wine rack 70 in a vertical column or arrangement. When supported in this manner, each wine bottle 14 is positioned to be extending outwardly from the support surface 12 such that the neck 18 is farthest from, and pointing away from the support surface 12. As shown, the wine rack 70 includes a first and second support frame 72, 74, configured to engage and support one or more wine bottles 14. In this regard, the first and second support frames 72, 74 are configured to support one or more wine bottles 14 in an improved manner that can survive various tremors, earthquakes, and other natural and unnatural vibratory disturbances without having the wine bottles 14 separate from the rack 10 and potentially break, as described in further detail below.

Figure 11:
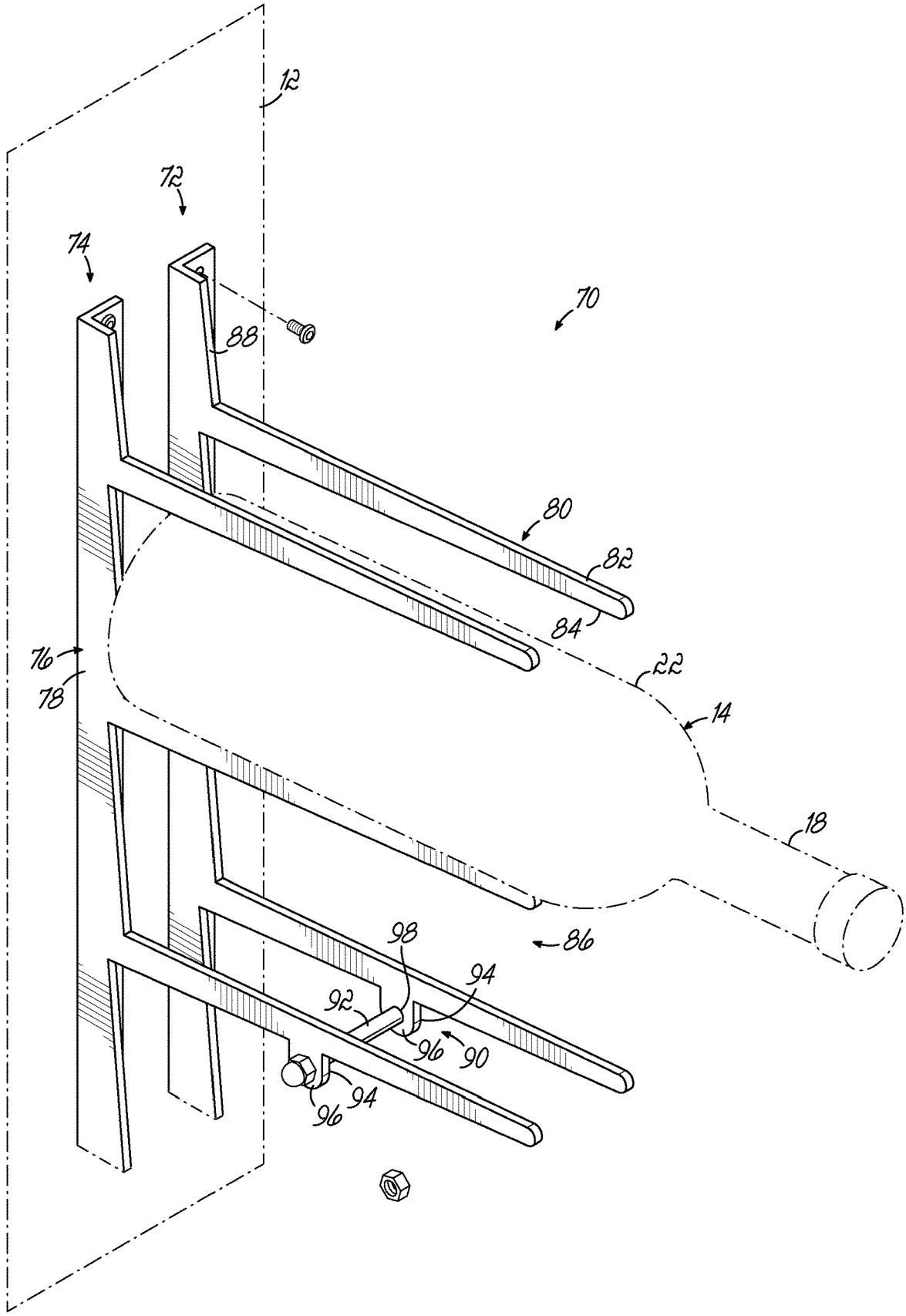
FIG. 11 is a partial perspective view of the wine rack shown in FIG. 10.

With continued reference to FIG. 11, each of the first and second support frames 72, 74 have a similar construction and generally include a body 76 having a base 78 and one or more elongate arms 80 extending away from the body 76 and outwardly from the base 78 and support surface 12 when mounted thereto. In this regard, the base 78 is configured to mount to the support surface 12 such that the base 78 is in engagement, or in near engagement, when the wine rack 70 is mounted to the support surface 12. In this regard, the first and second support frames 72, 74 may be mounted to the support surface 12 in a manner similar to that described above for wine rack 10. However, different configurations for the mounting system may be possible, such as screw and slot or keyhole mounting configurations, for example, without departing from the scope of the present invention.

Figure 12:
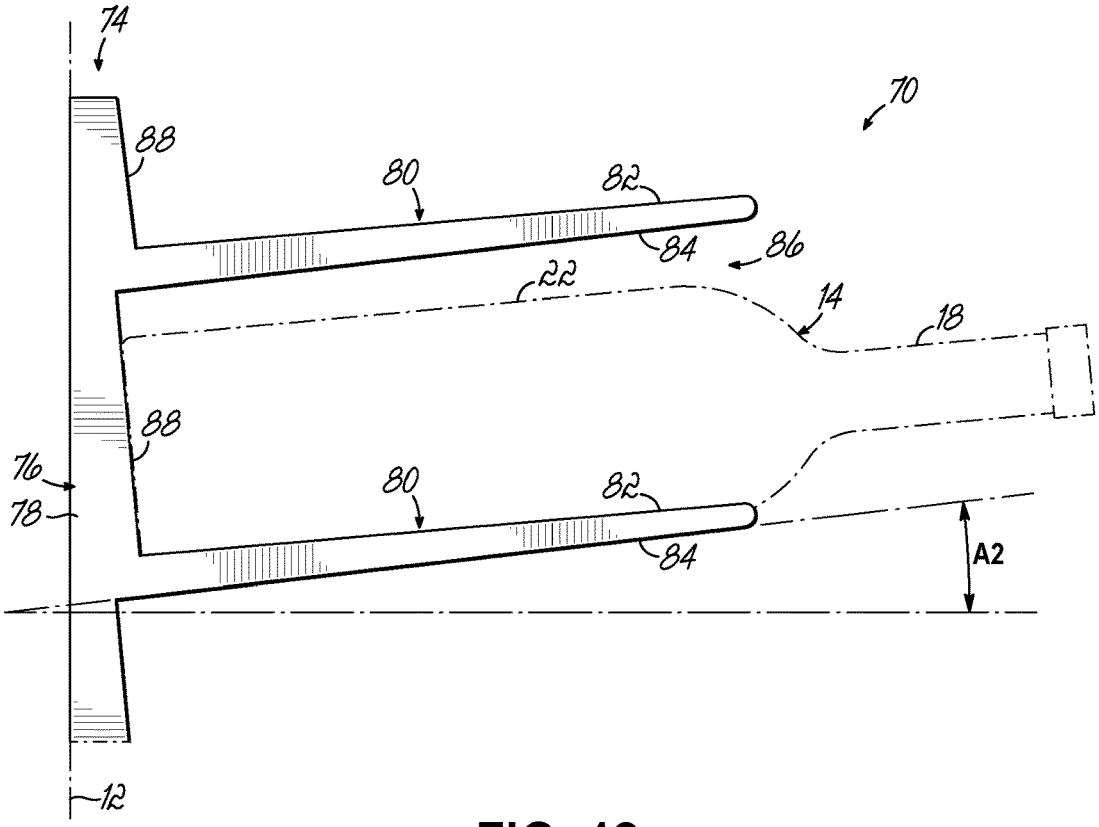
FIG. 12 is a partial, side elevation view of a support frame of the wine rack shown in FIG. 10.

As best shown in FIGS. 11 and 12, the body 76 of the first and second support frames 72, 74 may include one or more vertically arranged arms 80 extending away from the support surface 12. For example, each support frame 72, 74 may include between 1 and 30 support arms 80, depending on the desired size of the wine rack 70. The height of the wine rack 70 may be limited by, for example, the physical space in which the wine rack 70 is being positioned. As shown, each of the support arms 80 includes an upper, bearing surface 82 and a lower, nonbearing surface 84. The region between adjacent, vertically spaced arms 80 on each of the support frames 72, 74 defines a U-shaped cavity 86 having a base 88 which defines a generally planar wall. As described in further detail below, the support frames 72, 74 are mounted such that the bearing surface 82 of one support arm 80 on the first support frame 72 cooperates with a corresponding bearing surface 82 of one support arm 80 on the second support frame 74 to support a single wine bottle 14. In this regard, the length of the arms 80 may vary in order to adequately support the weight of a wine bottle 14. In the exemplary embodiment shown, the length of each support arm 80 generally corresponds to the size of the shank 22 of the wine bottle 14. In this regard, each support arm 80 may extend just beyond the shank 22 to the area of the wine bottle 14 where the diameter of the shank 22 reduces down to form the neck 18. However, the arms 80 may extend further, beyond the neck 18, for example, or alternatively, the arms 80 may stop at a point along the shank 22.

In the exemplary embodiment shown, when mounted to the support surface 12, the first and second support frames 72, 74 are spaced a predetermined distance apart so that a wine bottle 14 may be held in a cradled position by the corresponding support arms 80 located on the first and second support frames 72, 74. By way of example, the predetermined distance may be between 50-90 percent of the diameter of the wine bottle being supported in the rack. Changing the spacing of the first and second support frames 72, 74 will result in a larger or smaller portion of the wine bottle 14 being positioned in a space between the two corresponding support arms 80 when stored in the wine rack 70. For example, when the support frames 72, 74 are spaced farther apart, a larger portion of the wine bottle 14, and more particularly, the shank 22, is positioned in the space between the corresponding support arms 80 when stored in the wine rack 70. When supporting a wine bottle 14, each corresponding support arm 80 extends tangentially along the curved outer surface of the shank 22, providing line contact with the shank 22 and wine bottle 14. In this regard, each bearing surface 82 may have a radius of curvature that relates to or corresponds to the curved outer surface of a bottle 14. By way of example, the bearing surface 82 may have a radius of curvature of about one-eighth of an inch. However, it should be recognized that other values may be possible and remain within the scope of the present invention. Similarly, the nonbearing surfaces 84 of the support arms 80 may have a similar radius of curvature to that of the bearing surface 82 or, alternately, be polygonal in shape.

Figure 13:
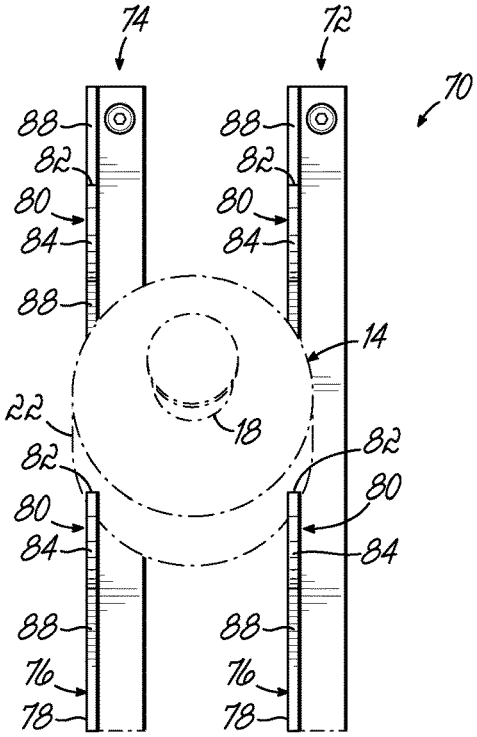
FIG. 13 is a partial, front elevation view of the support frame of the wine rack shown in FIG. 10.

In accordance with an aspect of the invention and as best illustrated in FIGS. 12 and 13, the arms 80 of the first and second support frames 72, 74 are configured to extend away from the support surface 12 at an angle A2. As shown, angle A2 creates a slightly greater than ninety degrees angle between the lower, nonbearing surface 84 of each support arm 80 and the support surface 12. By way of example, the support arms 80 may be configured to extend away from the support surface 12 at an angle between 2 degrees and 10 degrees greater than ninety degrees (i.e., perpendicular to the support surface 12). For example, the arms 80 may extend away from the support surface 12 at an angle 5 degrees greater than perpendicular (i.e., A2 is equal to 5 degrees). Angle A2 functions to keep the shank 22 of the wine bottle 14 engaged with the base 78 of each of the support frames 72, 74.

In this regard, and as best illustrated in FIG. 12, the base 88 of each U-shaped cavity 86 is configured to engage the shank 22 of a wine bottle 14 when held in the wine rack 70 in an angled position as described above. As shown, the curvature of the surface between the bearing surface 82 of each support arm 80 and the base 86 corresponds to the curved outer surface of the base of the wine bottle 14. In this regard, when the wine bottle 14 is stored in the wine rack 70, the base 88 of each U-shaped cavity 86 is configured to be in engagement, or in near engagement, with the base of the wine bottle 14 shank 22. To facilitate the positioning of the wine bottle 14 at angle A2, each U-shaped cavity 86 is angled such that the base 88 of one U-shaped cavity 86 is off-set from the base 86 of the next closest U-shaped cavity 86. For example, the base 88 of each U-shaped cavity 86 may be angled inwardly from vertical (i.e., vertical to the support surface 12), towards the support surface 12, at an angle similar to that of A2. As a result, the nonbearing, lower surface 84 of each support arm 80 is longer in length compared to the length of the bearing, upper surface 82 of each support arm 80 (see FIG. 12). Accordingly, the combination of the support arms 80 cradling a stored wine bottle 14, the angled position of the support arms 80, and the U-shaped cavity 88, as described above, cooperate to provide for controlling wine bottles 14 supported in the wine rack 70.

In accordance with another aspect of the invention, the wine rack 70 may include one or more support features to prevent the first and second support frames 72, 74 from pulling apart under the weight of the stored wine bottles 14. As best illustrated in FIG. 11, one or more corresponding support arms 80 of the first and second support frames 72, 74 may be provided with a cross support feature 90 that includes at least one stabilizing assembly 92 and one or more attachment points 94 to which the stabilizing assembly 92 is configured to secure. In the embodiment shown, each attachment point 94 of the first and second support frames 72, 74 includes a boss 96 with a centrally located aperture 98 configured to engage with the stabilizing assembly 92. The boss 96 projects from the lower, nonbearing surface 84 of each corresponding support arm 80 of the first and second support frames 72, 74. The centrally located aperture 98 of each boss 96 is configured to receive a portion of the stabilizing assembly 92 therethrough. In this regard, each boss 96 is positioned on corresponding support arms of the first and second frames 72, 74 so that the apertures 96 are axially aligned when the wine rack 70 is mounted to the support surface 12. To this end, the stabilizing assembly 92 may be positioned through the aperture 96 of each boss 94 and secured thereto. When so positioned, the stabilizing assembly 92 prevents the first and second support frames 72, 74 from moving apart in a lateral direction, for example. In one embodiment, the stabilizing assembly 92 may be a nut and bolt combo. However, other means are possible for the stabilizing assembly 92 such as a pin and clip combo, a lynch pin, a quick release pin, or other. Alternatively, the stabilizing assembly 92 may be fixed and nonremovable such as a pin welded in place to the attachment points 94. The cross support assemblies 90 further provide for controlling wine bottles 14 supported in the wine rack 70 during a relatively small seismic event, for example. Thus, while there may be some shifting of bottles 14 in the wine rack 70, the chances of any bottles 14 becoming separated from the rack 10 is reduced.

Figure 14:
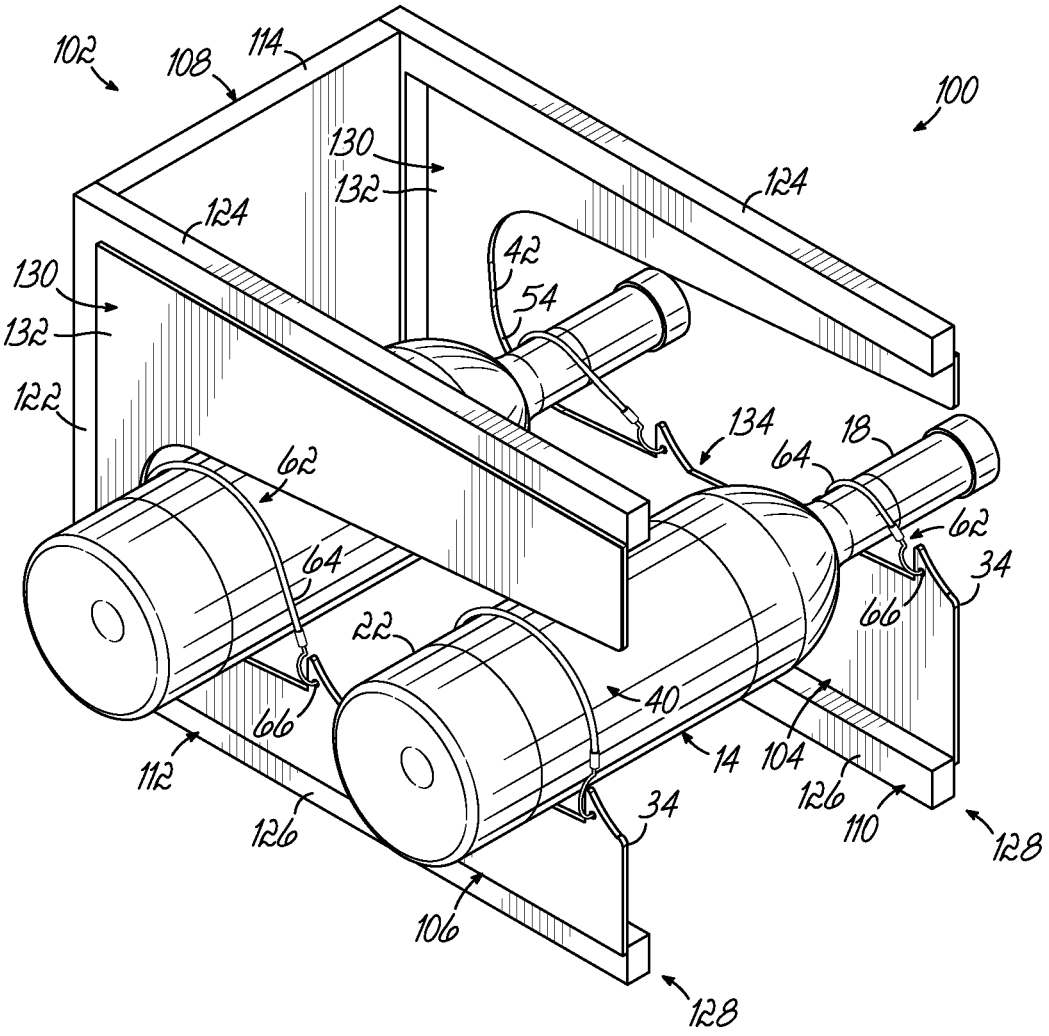
FIG. 14 is a schematic perspective view of a countertop wine rack in accordance with an embodiment of the invention.
Figure 15:
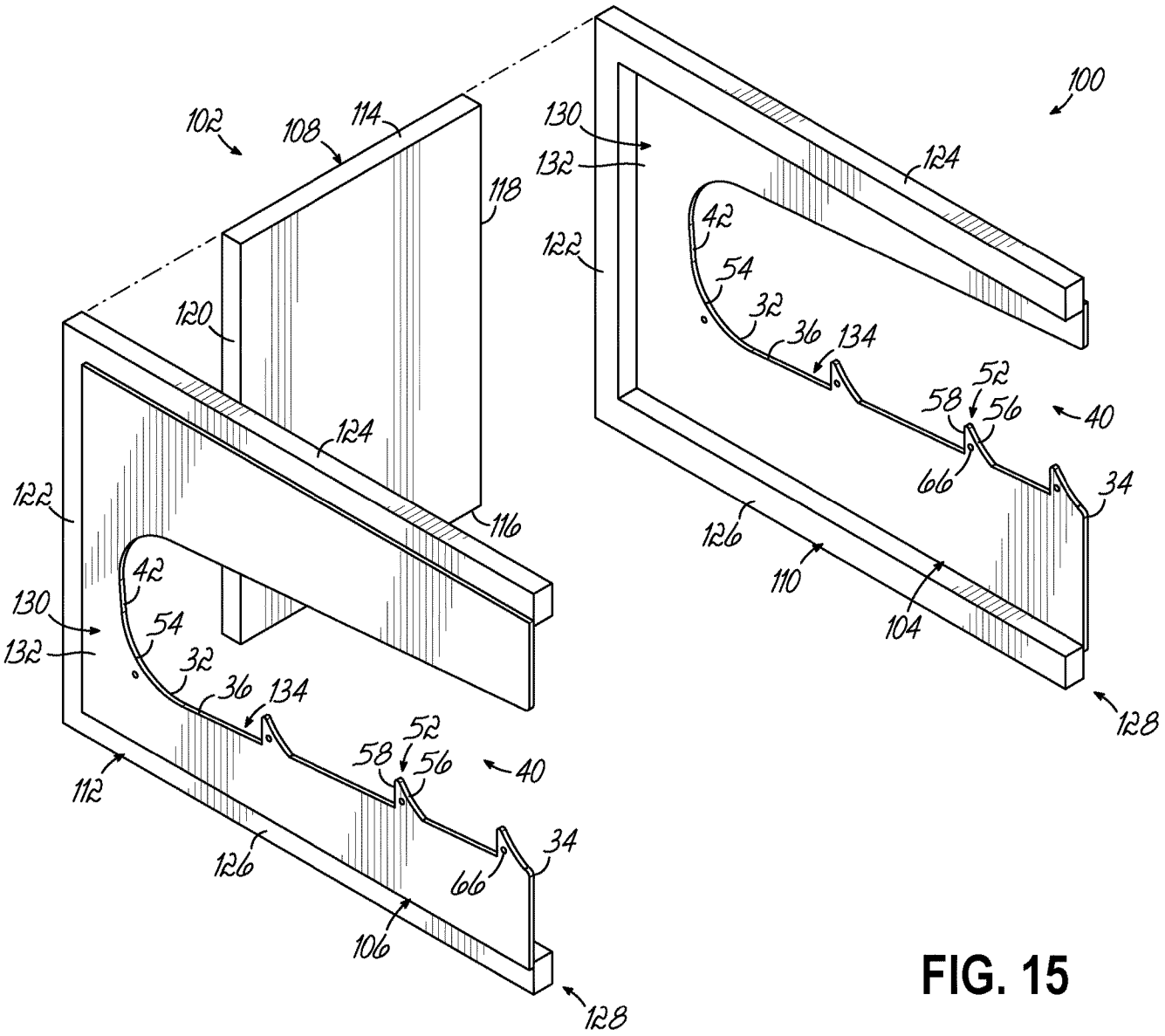
FIG. 15 is a schematic perspective view of the wine rack illustrated in FIG. 9 but without the wine bottles.

FIGS. 14 and 15 illustrate another embodiment in accordance with aspects of the invention. These figures illustrate a stand-alone wine rack 100 configured to hold one or more bottles 14 in a manner similar to that described above for wine rack 10. By way of example, the stand-alone rack 100 may be suitable for a countertop, desk, table or other generally horizontal support surface. The stand-alone rack 100 includes a support structure 102, a first support frame 104, and a second support frame 106. In an exemplary embodiment, the support structure 102 includes a rear panel 108, a first side panel 110 and a second side panel 112. The rear panel 108 may be generally solid and include opposed upper and lower edges 114, 116 and opposed side edges 118, 120. Each of the side panels 110, 112 includes three elongate members arranged in a U-shape that defines a base leg 122 and upper and lower legs 124, 126. The base leg 122 of the first and second side panels 110, 112 is respectively coupled to side edges 118, 120 of the rear panel 108 such that the legs 124, 126 extend away from the rear panel 108 and toward a tip end 128 of the rack 100. By way of example, the first and second side panels 110, 112 may be bonded to the rear panel 108 or coupled together with a suitable fastener.

The first support frame 104 may be coupled to the first side panel 110 and the second support frame 106 may be coupled to the second side panel 112. More particularly, the first and second support frames 104, 106 may be coupled to each of the legs 122, 124, 126 that form the side panels 110, 112, such as by using a suitable adhesive or suitable fastener. As illustrated in FIGS. 14 and 15, the first and second support frames 104, 106 have many of the same features as the first and second support frames 16, 20 described above. More particularly, the first and second support frames 104, 106 include a plate-like body 130 having a base 132 and a pair of elongate arms 134 extending away from the base 132 and outwardly from the rear panel 108 to define at least one U-shaped cavity 40 having a base 42 adjacent a rear edge 30 of the base 132. The upper surface 36 of the lower arms 134 includes one or more bottle contoured gravity stops 52 similar to that described above. The arrangement of the arms 134 and the bottle contoured gravity stops 52 are similar to that described above for wine rack 10 and a further description will not be provided herein.

While the present invention has been illustrated by a description of various preferred embodiments and while these embodiments have been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user.

What is claimed is:

1. A wine rack, comprising:

a first support frame configured to be mounted to a support surface, the first support frame including a first base and at least one arm extending from the first base to a first tip, the at least one arm configured to support a first portion of a bottle; and a second support frame configured to be mounted to the support surface in spaced relation to the first support frame, the second support frame including a second base and at least one arm extending from the second base to a second tip, the at least one arm configured to support a second portion of the bottle;

wherein the at least one arm of the first and second support frames includes one or more bottle contoured gravity stops having an arcuate forward face facing in a direction of the corresponding first or second tip for engaging with the respective portion of the bottle and a planar rear face facing in a direction of the corresponding first or second base and being perpendicular to the at least one arm from which it extends, and wherein the at least one arm of the first and second support frames is inclined at an acute angle relative to horizontal to urge the bottle to engage with the arcuate forward faces.

2. The wine rack of claim 1, wherein the at least one arm of the first support frame is integrally formed with the base so as to define a one-piece construction and the at least one arm of the second support frame is integrally formed with the base so as to define a one-piece construction.

3. The wine rack of claim 1, wherein the one or more bottle contoured gravity stops are integrally formed with the at least one arm of the first and second support frames.

4. The wine rack of claim 1, further comprising a locking mechanism including one or more safety straps.

5. The wine rack of claim 4, wherein the first and second support frames include one or more attachment points for engaging with the one or more safety straps.

6. The wine rack of claim 5, wherein at least one of the one or more attachment points is positioned on the contoured gravity stops.

7. The wine rack of claim 1, wherein the at least one arm extending from the base on the first support frame is offset in a vertical direction from the corresponding at least one arm extending from the base on the second support frame.

8. The wine rack of claim 1, wherein the one or more bottle contoured gravity stops on the first support frame are offset in a lateral direction from the one or more bottle contoured gravity stops on the second support frame.

9. The wine rack of claim 1, wherein the first support frame includes a first support leg and side panel and the second support frame includes a second support leg and side panel, wherein the first support frame and second support frame are coupled to a support structure for supporting the wine rack in a stand-alone configuration.

* * * * *